US010669672B2

(12) United States Patent
Rao

(10) Patent No.: US 10,669,672 B2
(45) Date of Patent: Jun. 2, 2020

(54) COMPOSITIONS AND METHODS FOR TREATING FILLER IN PAPERMAKING

(71) Applicant: ECOLAB USA INC., St. Paul, MN (US)

(72) Inventor: Qinglong Rao, Shanghai (CN)

(73) Assignee: Ecolab USA Inc., St. Paul, MN (US)

( * ) Notice: Subject to any disclaimer, the term of this patent is extended or adjusted under 35 U.S.C. 154(b) by 40 days.

(21) Appl. No.: 15/765,137

(22) PCT Filed: Sep. 30, 2016

(86) PCT No.: PCT/CN2016/101171
§ 371 (c)(1),
(2) Date: Mar. 30, 2018

(87) PCT Pub. No.: WO2017/054774
PCT Pub. Date: Apr. 6, 2017

(65) Prior Publication Data

US 2019/0055696 A1 Feb. 21, 2019

(30) Foreign Application Priority Data

Sep. 30, 2015 (WO) ..... PCT/CN2015/091314

(51) Int. Cl.

| | |
|---|---|
| ***D21H 17/00*** | (2006.01) |
| ***D21H 17/37*** | (2006.01) |
| ***D21H 17/69*** | (2006.01) |
| ***D21H 17/29*** | (2006.01) |
| ***D21H 17/28*** | (2006.01) |
| ***D21H 21/18*** | (2006.01) |
| ***D21H 17/67*** | (2006.01) |
| ***D21H 17/43*** | (2006.01) |
| ***D21H 17/45*** | (2006.01) |
| ***D21H 17/68*** | (2006.01) |

(52) U.S. Cl.
CPC ..... *D21H 17/69* (2013.01); *D21H 17/28* (2013.01); *D21H 17/29* (2013.01); *D21H 17/37* (2013.01); *D21H 17/375* (2013.01); *D21H 17/43* (2013.01); *D21H 17/455* (2013.01); *D21H 17/67* (2013.01); *D21H 17/675* (2013.01); *D21H 17/68* (2013.01); *D21H 17/74* (2013.01); *D21H 21/18* (2013.01)

(58) Field of Classification Search
None
See application file for complete search history.

(56) References Cited

U.S. PATENT DOCUMENTS

| | | | | |
|---|---|---|---|---|
| 4,272,297 | A * | 6/1981 | Brooks | C08L 3/02 106/465 |
| 4,799,964 | A | 1/1989 | Harvey et al. | |
| 4,824,523 | A | 4/1989 | Wagberg et al. | |
| 6,077,441 | A * | 6/2000 | Luke | B01D 21/01 210/712 |
| 6,494,991 | B1 | 12/2002 | Palmer et al. | |
| 8,088,213 | B2 | 1/2012 | Cheng et al. | |
| 8,088,250 | B2 | 1/2012 | Cheng et al. | |
| 8,172,983 | B2 | 5/2012 | Cheng et al. | |
| 8,465,623 | B2 | 6/2013 | Zhao et al. | |
| 8,647,472 | B2 | 2/2014 | Cheng et al. | |
| 8,709,208 | B2 | 4/2014 | Zhao et al. | |
| 8,747,617 | B2 | 6/2014 | Cheng et al. | |
| 8,778,140 | B2 | 7/2014 | Cheng et al. | |
| 2002/0100564 | A1 | 8/2002 | Harvey et al. | |
| 2009/0020250 | A1 | 1/2009 | Kimura et al. | |
| 2009/0065162 | A1 | 3/2009 | Cheng et al. | |
| 2009/0123525 | A1* | 5/2009 | Bedard | A61K 33/06 424/443 |
| 2009/0162642 | A1 | 6/2009 | Ono et al. | |
| 2009/0267258 | A1 | 10/2009 | Cheng et al. | |
| 2010/0126684 | A1 | 5/2010 | Cheng et al. | |
| 2011/0088861 | A1 | 4/2011 | Cheng | |
| 2013/0306261 | A1 | 11/2013 | Zhao et al. | |
| 2015/0068697 | A1* | 3/2015 | Karppi | C08L 3/08 162/164.3 |
| 2015/0197890 | A1* | 7/2015 | Laakso | D21H 17/74 162/164.2 |

FOREIGN PATENT DOCUMENTS

| | | |
|---|---|---|
| CN | 1238820 | 12/1999 |
| CN | 101133210 A | 2/2008 |
| CN | 101275372 A | 10/2008 |
| CN | 101370981 A | 2/2009 |
| CN | 101755092 A | 6/2010 |
| CN | 101802304 A | 8/2010 |
| CN | 102277776 A | 12/2011 |
| CN | 102720092 A | 10/2012 |
| CN | 103147347 A | 6/2013 |

(Continued)

OTHER PUBLICATIONS

Extended European Search Report for Application No. 16850398.5 dated May 7, 2019.
International Search Report and Written Opinion of the International Searching Authority for International Patent Application No. PCT/CN2016/101171 dated Jan. 6, 2017, 7 pages.
Hagiopol, C. et al., "Chemistry of Modern Papermaking", CRC Press, 8 pages (2012).
Wurzburg, "Modified Starches: Properties and Uses", CRC Press, 5 pages (1986).
Brazilian Office Action for BR112018006355-0, dated Jan. 10, 2020.

*Primary Examiner* — Dennis R Cordray
(74) *Attorney, Agent, or Firm* — Merchant & Gould P.C.

(57) ABSTRACT

Method of papermaking comprises: treating filler with a starch and a flocculant to form a filler floc; combining the filler floc with the cellulose fiber stock; and forming a paper mat from the combination of filler floc and cellulose fiber stock. The method have been found to result in larger particle sizes for the filler flocs, improved shear stability, and improved sheet strength in the paper mat.

16 Claims, 4 Drawing Sheets

(56) References Cited

FOREIGN PATENT DOCUMENTS

| | | | |
|---|---|---|---|
| CN | 103422395 | A | 12/2013 |
| CN | 103547734 | A | 1/2014 |
| CN | 103911900 | A | 7/2014 |
| CN | 104053836 | A | 9/2014 |
| CN | 103038419 | | 4/2015 |
| EP | 0 994 216 | A1 | 4/2000 |
| FR | 2 396 831 | A1 | 2/1979 |
| GB | 1 405 751 | A | 9/1975 |
| GB | 2 016 498 | A | 9/1979 |
| GB | 2 181 464 | A | 4/1987 |
| JP | H10-60794 | A | 3/1998 |
| JP | 2012-214963 | A | 11/2012 |
| KR | 2005-0023824 | A | 3/2005 |
| WO | 2010/062943 | A1 | 6/2010 |
| WO | 2013/107933 | A1 | 7/2013 |
| WO | 2013/162176 | A1 | 10/2013 |
| WO | 2014/123087 | A1 | 8/2014 |
| WO | 2015/095377 | A1 | 6/2015 |
| WO | 2015/101499 | A1 | 7/2015 |

* cited by examiner

COMPOSITIONS AND METHODS FOR TREATING FILLER IN PAPERMAKING

This application is a National Stage Application of PCT/CN2016/101171, filed 30 Sep. 2016, which claims the benefit of priority to International PCT Patent Application No. PCT/CN2015/091314, filed 30 Sep. 2015, the entire disclosures of which are incorporated by reference in their entireties. To the extent appropriate, a claim of priority is made to each of the above disclosed applications.

BACKGROUND

Increasing the filler content in printing and writing papers is of great interest for improving product quality as well as reducing raw material and energy costs. However, the substitution of cellulose fibers with fillers like calcium carbonate and clay reduces the strength of the finished sheet. Another problem when the filler content is increased is an increased difficulty of maintaining an even distribution of fillers across the three-dimensional sheet structure. An approach to reduce these negative effects of increasing filler content is to preflocculate fillers before their addition to the wet end approach system of the paper machine.

The term "preflocculation" refers to the modification of filler particles into agglomerates through treatment with coagulants and/or flocculants before their flocculation and addition to the furnish stock. The flocculation treatment and shear forces of the process determine the size distribution and stability of the flocs before addition to the furnish stock. The chemical environment and high fluid shear rates present in modern high-speed papermaking require filler flocs to be stable and shear resistant. The floc size distribution provided by a preflocculation treatment should minimize the reduction of sheet strength with increased filler content, minimize the loss of optical efficiency from the filler particles, and minimize negative impacts on sheet uniformity and printability. Furthermore, the entire system must be economically feasible.

Therefore, the combination of high shear stability and sharp particle size distribution is vital to the success of filler preflocculation technology. However, filler flocs formed by a low molecular weight coagulant alone, including commonly used starch, tend to have a relatively small particle size that breaks down under the high shear forces of a paper machine. Filler flocs formed by a single high molecular weight flocculant tend to have a broad particle size distribution that is difficult to control, and the particle size distribution gets worse at higher filler solids levels, primarily due to the poor mixing of viscous flocculant solution into the slurry. Accordingly, there is an ongoing need for improved preflocculation technologies.

SUMMARY

In one embodiment, the present disclosure relates to a method of papermaking where filler is treated with a combination of a starch and a cationic flocculant to form a filler floc. The filler floc is then combined with cellulose fiber stock to form a paper mat from the combination of filler floc and cellulose fiber stock. In some embodiments, the starch and the cationic flocculant are premixed together before treatment with the filler. In some embodiments, the starch and the cationic flocculant are added to the filler simultaneously.

In another embodiment, the present disclosure relates to a method of papermaking where the filler is treated other ionic combinations of a starch and a flocculant to form a filler floc. Exemplary combinations include the combination of a nonionic starch with an anionic flocculant, or an anionic starch with an anionic flocculant. The filler floc is then combined with the cellulose fiber stock to form a paper mat from the combination of the filler floc and the cellulose fiber stock. In some embodiments, the starch and the flocculant are premixed together before treatment with the filler. In some embodiments, the starch and the flocculant are added to the filler simultaneously.

DETAILED DESCRIPTION

Figure 1:
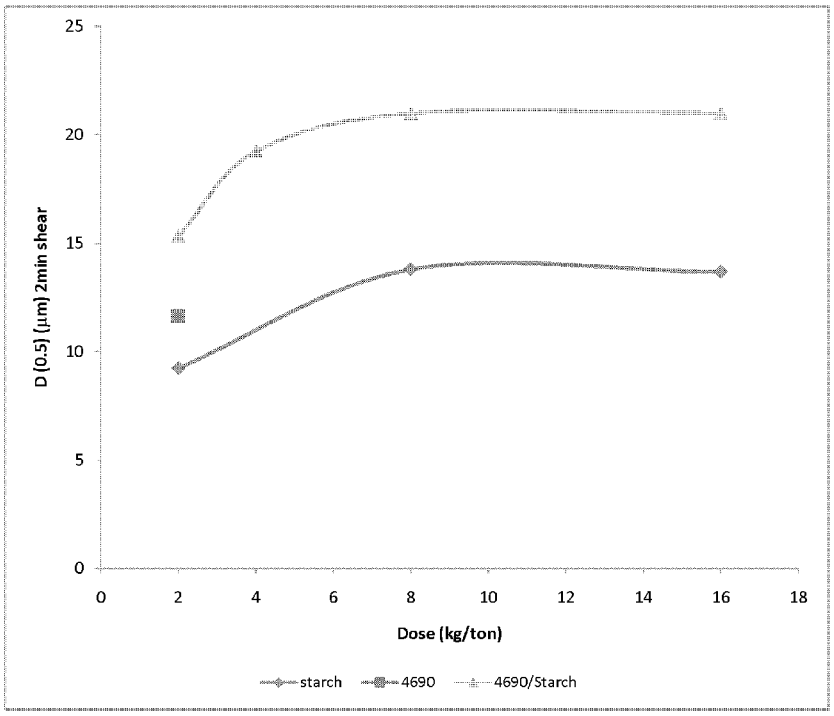
FIG. 1 is a graph of the particle size of various filler treatments as the concentration of cationic starch is increased.

In some embodiments, the present disclosure relates to a method of treating filler particles in a papermaking process by premixing a starch with a cationic flocculant and then combining the premixed starch/flocculant mixture with the filler. Premixing the starch and the cationic flocculant before adding it to the filler has been found to result in an increased particle size of the filler. Increasing the particle size of the filler is believed to have several benefits. First, it results in improved shear stability of the filler. Second, it decreases the surface area of the filler, which causes the filler to interfere less with the cellulose-cellulose hydrogen bonding once the filler and cellulose are combined. Third, the improved cellulose bonding results in a stronger sheet strength.

In some embodiments, the present disclosure relates to a method of treating filler particles in a papermaking process where the starch and the cationic flocculant are added simultaneously to the filler. This process also results in an increased particle size of the filler, improved cellulose-cellulose bonding and stronger sheet strength, especially compared to the sequential addition of the starch and the flocculant.

In some embodiments, the present disclosure relates to a method of treating filler particles in a papermaking process by premixing a starch with a flocculant and then combining the premixed starch/flocculant mixture with the filler. Exemplary combinations of starch and flocculant include cationic starch with a cationic flocculant; cationic starch with a nonionic flocculant; nonionic starch with a cationic flocculant; nonionic starch with a nonionic flocculant; nonionic starch with an anionic flocculant; or an anionic starch with an anionic flocculant. Zwitterionic or amphoteric starches could also be used with either a cationic, nonionic or anionic flocculant.

Fillers

Exemplary fillers include any inorganic or organic particle or pigment used to increase the opacity or brightness, increase the smoothness, or reduce the cost of the paper or paperboard sheet. Exemplary fillers include calcium carbonate, kaolin clay, talc, titanium dioxide, silica, silicate, aluminum hydroxide, calcium sulfate, alumina trihydrate, barium sulfate, magnesium hydroxide, and the like. Calcium carbonate includes ground calcium carbonate (or GCC) in a dry or dispersed slurry form, chalk, precipitated calcium carbonate (or PCC) of any morphology and precipitated calcium carbonate in a dispersed slurry form. The dispersed slurry forms of GCC or PCC are typically produced using polyacrylic acid polymer dispersants or sodium polyphosphate dispersants. Each of these dispersants imparts a significant anionic charge to the calcium carbonate particles. Kaolin clay slurries may also be dispersed using polyacrylic acid polymers or sodium polyphosphate.

In some embodiments, the filler is selected from calcium carbonate, kaolin clay and combinations thereof. In some embodiments, the filler is selected from precipitated calcium carbonate, ground calcium carbonate, kaolin clay and combinations thereof. In some embodiments the filler is 100% ground calcium carbonate, 100% precipitated calcium carbonate, a mixture of ground calcium carbonate and other fillers, a mixture of precipitated calcium carbonate and other fillers, or a mixture of ground calcium carbonate and precipitated calcium carbonate, optionally with other fillers.

Starch

The starch is preferably a raw starch, nonionic starch, cationic starch, anionic starch, zwitterionic or amphoteric starch, or a mixture of thereof. In some embodiments, the starch is preferably a raw starch, a nonionic starch or a cationic starch. In some embodiments, the starch is a cationic starch.

Raw starches include but are not limited corn, potato, rice, waxy maize, wheat, sago and tapioca starches that have not been chemically modified.

Nonionic starches include but are not limited to corn, potato, rice, waxy maize, wheat, sago and tapioca starches that have been modified in a way such that they carry a neutral charge. Exemplary nonionic modifications include acid-modified starch, oxidized starch (e.g., with hydrogen peroxide, peracetic acid, permanganate, persulfate), halogen-modified starch (e.g., chlorine, hypochlorite, bromine, hypobromite), dialdehyde starches, dextrins, acetylated starch, hydroxyethylated starches (e.g., starch reacted with ethylene oxide), hydroxypropylated starches (e.g., starch reacted with propylene oxide), phosphorylated starches (e.g., starches reacted with ortho-, pyro-, meta-, or tripolyphosphates), starch phosphate diesters, starch phosphates, starch sulfates, starch nitrates, and starch xanthate, allyl starch, benzyl starch, carbamoylethyl starch, carboxymethyl starch, cyanomethyl starch and methyl and ethyl starches.

Cationic starches include but are not limited corn, potato, rice, waxy maize, wheat, sago and tapioca starches that have been modified in a way such that they carry a positive charge. Primary reagents for preparing cationic starches including those with amino, imino, ammonium, sulfonium or phosphonium groups. Accordingly, one exemplary class of cationic starches includes tertiary aminoalkyl starch ethers having the general structure:

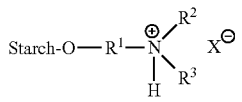

where $R^1$, $R^2$ and $R^3$ are either substituted or unsubstituted alkyl groups and $X^-$ is a counterion. Another class of cationic starches includes quaternary ammonium starch ethers having the general structure:

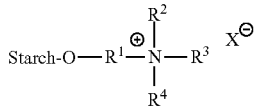

where $R^1$, $R^2$, $R^3$ and $R^4$ are either substituted or unsubstituted alkyl groups and $X^-$ is a counterion. Another class of cationic starches includes iminoalkyl starches having the general structure:

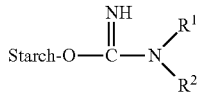

where $R^1$ and $R^2$ are either substituted or unsubstituted alkyl groups. These iminoalkyl starches show cationic activity after acidification with acids. Another class of cationic starches includes aminoalkyl starches having the general structure:

Starch-O—$RNH_2$ where R is a substituted or unsubstituted alkyl group. These aminoalkyl starches show cationic activity after acidification with acids.

In some embodiments, the cationic starch is selected to have a charge density of from about 1 to about 10 mol. %, about 2 to about 8 mol. % or about 3 to about 5 mol. %.

Anionic starches include but are not limited corn, potato, rice, waxy maize, wheat, sago and tapioca starches that have been modified in a way such that they carry a negative charge. Exemplary anionic starches include starch succinates where the starch has been reacted with succinic anhydride to form the following structure:

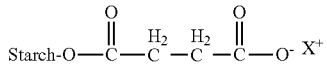

where $X^+$ is a counterion such as sodium. Another example is a starch that has been reacted with a substituted cyclic dicarboxylic acid anhydride such as an alkenylsuccinate. An exemplary structure includes the following:

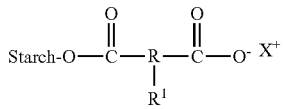

where $X^+$ is a counter ion such as sodium, R is a dimethylene or trimethylene radical and $R^1$ is an alkyl group. Another example of an anionic starch is a starch sulfosuccinate where the starch has been modified with a maleate ester and then reacted with sodium bisulfate to form a sulfosuccinate derivative with the following structure:

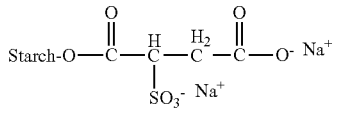

Zwitterionic starches include but are not limited corn, potato, rice, waxy maize, wheat, sago and tapioca starches that have been modified in a way such that they carry both a positive and a negative charge. One example of a zwitterionic starch is a starch that has been modified with N-(2-haloethyl)iminobis-(methylene)diphosphonic acid or N-(alkyl)-N-(2-haloethyl)aminomethylphosphonic acid. This modification produces anionic methylene-phosphonic acid groups and a cationic nitrogen.

Amphoteric starches include but are not limited corn, potato, rice, waxy maize, wheat, sago and tapioca starches that have been modified in a way such that they carry both a positive and a negative charge. Exemplary amphoteric starches include tertiary or quaternary ammonium starch ethers that have been treated with an ammonium chloride species and further substituted with phosphate, phosphonate, sulfate, sulfonate or carboxyl groups.

In some embodiments, the starch dose is at least about 0.5, 1, 5, 10, 15, 20, 25, 30, 35, 40, 45, 50, 55, 60, 65, 70, 75, 80, 85, 90, 95 or 100 kg/ton of filler treated. In some embodiments, the starch dose is from about 0.5 to about 500 kg/ton of filler treated, from about 10 to about 200 kg/ton of filler treated, or from about 50 to about 100 kg/ton of filler treated, where kg/ton refers to the kilograms of active starch per 1 ton of dry filler.

Flocculant

The flocculant is preferably a cationic flocculant or a mixture of a cationic flocculant with an anionic, nonionic, zwitterionic or amphoteric flocculant. Without wishing to be bound by theory, it is believed that the fillers generally have an anionic charge associated with them and that the addition of a cationic flocculant provides a desirable charge balance between the flocculant and the filler. It is further believed that premixing the starch and the flocculant assists with this charge balance and improves the ability of the flocculant to mix with the filler. It is understood that the selection of a cationic flocculant is a preferred embodiment. Other combinations of starch and flocculant can be used including anionic, nonionic, amphoteric and zwitterionic flocculants (or a combination thereof) with a cationic, anionic, nonionic, zwitterionic or amphoteric starch (or a combination thereof). Exemplary combinations of starch and flocculant include cationic starch with a cationic flocculant; cationic starch with a nonionic flocculant; nonionic starch with a cationic flocculant; nonionic starch with a nonionic flocculant; nonionic starch with an anionic flocculant; an anionic starch with an anionic flocculant; or anionic starch with a nonionic flocculant. Zwitterionic or amphoteric starches could also be used with either a cationic, nonionic, anionic, zwitterionic, or amphoteric flocculant. Likewise, zwitterionic or amphoteric flocculants could be used with a cationic, nonionic, anionic, zwitterionic or amphoteric starch.

In some embodiments, the flocculant has a molecular weight in excess of 200,000 Da, 500,000 Da, 1,000,000 Da, 3,000,000 Da, 5,000,000 Da, or 20,000,000 Da. In some embodiments, the molecular weight is from about 200,000 to about 20,000,000 Da, from about 500,000 to about 5,000,000 Da, from about 1,000,000 to about 5,000,000 Da, from about 1,000,000 to about 3,000,000 Da or from about 3,000,000 to about 5,000,000 Da.

A polymeric flocculant is typically prepared by vinyl addition polymerization of one or more cationic, anionic or nonionic monomers, by copolymerization of one or more cationic monomers with one or more nonionic monomers, by copolymerization of one or more anionic monomers with one or more nonionic monomers, by copolymerization of one or more cationic monomers with one or more anionic monomers and optionally one or more nonionic monomers to produce an amphoteric polymer or by polymerization of one or more zwitterionic monomers and optionally one or more nonionic monomers to form a zwitterionic polymer. One or more zwitterionic monomers and optionally one or more nonionic monomers may also be copolymerized with one or more anionic or cationic monomers to impart cationic or anionic charge to the zwitterionic polymer.

In an embodiment of the present invention, the content of the cationic charge in the flocculant can be obtained by dividing the mole number of the cationic monomer in the flocculant by the total mole number of the monomer and then multiplying by 100%. In some embodiments, the flocculants have a charge density of less than about 80 mol. %, less than about 60 mol. %, or less than about 40 mol. %, or less than about 20 mol. %, or less than about 10 mol. %, or less than about 5 mol. %. In some embodiments, the flocculants have a charge density of about 1 to about 50 mol. %, about 5 to about 40 mol. %, or about 10 to about 30 mol. %.

While cationic polymer flocculants may be formed using cationic monomers, it is also possible to react certain nonionic vinyl addition polymers to produce cationically charged polymers. Polymers of this type include those prepared through the reaction of polyacrylamide with dimethylamine and formaldehyde to produce a Mannich derivative.

Similarly, while anionic polymer flocculants may be formed using anionic monomers, it is also possible to modify certain nonionic vinyl addition polymers to form anionically charged polymers. Polymers of this type include, for example, those prepared by the hydrolysis of polyacrylamide.

The flocculant may be prepared in the solid form, as an aqueous solution, as a water-in-oil emulsion, or as a dispersion in water. Exemplary cationic polymers include copolymers and terpolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate, methyl chloride or benzyl chloride. Exemplary anionic polymers include copolymers of acrylamide with sodium acrylate and/or 2-acrylamido 2-methylpropane sulfonic acid (AMPS) or an acrylamide homopolymer that has been hydrolyzed to convert a portion of the acrylamide groups to acrylic acid.

Additional flocculants include cationically charged vinyl addition polymers such as homopolymers, copolymers, and terpolymers of (meth)acrylamide, diallyl-N,N-disubstituted ammonium halide, dimethylaminoethyl methacrylate and its quaternary ammonium salts, dimethylaminoethyl acrylate and its quaternary ammonium salts, methacrylamidopropyltrimethylammonium chloride, diallylmethyl(beta-propionamido)ammonium chloride, (beta-methacryloyloxyethyl) trimethyl ammonium methylsulfate, quaternized polyvinyllactam, vinylamine, and acrylamide or methacrylamide that has been reacted to produce the Mannich or quaternary Mannich derivatives. Suitable quaternary ammonium salts may be produced using methyl chloride, dimethyl sulfate, or benzyl chloride. The terpolymers may include anionic monomers such as acrylic acid or 2-acrylamido 2-methylpropane sulfonic acid as long as the overall charge on the polymer is cationic.

Other suitable flocculants include alum, sodium aluminate, polyaluminum chlorides, aluminum chlorohydroxide, aluminum hydroxide chloride, polyaluminum hydroxychloride, sulfated polyaluminum chlorides, polyaluminum silica sulfate, ferric sulfate, ferric chloride, epichlorohydrin-dimethylamine (EPI-DMA), EPI-DMA ammonia crosslinked polymers, polymers of ethylene dichloride and ammonia, polymers of ethylene dichloride, polymers of dimethylamine, condensation polymers of multifunctional diethylenetriamine, condensation polymers of multifunctional tetraethylenepentamine, condensation polymers of multifunctional hexamethylenediamine condensation polymers of multifunctional ethylenedichloride, melamine polymers, formaldehyde resin polymers, cationically charged vinyl addition polymers, and any combination thereof.

In some embodiments, the cationic flocculant is a copolymer of a quaternized N,N-dialkylaminoethyl (meth)acrylate (DMAEA.MCQ) and acrylamide such as DEV210 (Nalco Company, Naperville, Ill.) or a copolymer of diallyldimethylammonium chloride (DADMAC) and acrylamide such as N-7527 (Nalco Company, Naperville, Ill.).

In an embodiment, the flocculants have an RSV of at least 0.5 dL/g, at least 1 dL/g, at least 3 dL/g, at least 10 dL/g, or at least 15 dL/g where "RSV" stands for reduced specific viscosity. Within a series of polymer homologs which are substantially linear and well solvated, "reduced specific viscosity" or RSV measurements for dilute polymer solutions are an indication of polymer chain length and average molecular weight according to *Determination of Molecular Weights*, by Paul J. Flory, pages 266-316, *Principles of Polymer Chemistry*, Cornell University Press, Ithaca, N.Y., Chapter VII (1953). The RSV is measured at a given polymer concentration and temperature and calculated as follows:

$$RSV=[(\eta/\eta_o)-1]/c$$

where $\eta$=viscosity of polymer solution, $\eta_o$=viscosity of solvent at the same temperature and c=concentration of polymer in solution.

The units of concentration "c" are (grams/100 ml or g/deciliter). Therefore, the units of RSV are dL/g. Unless otherwise specified, a 1.0 molar sodium nitrate solution is used for measuring RSV. The polymer concentration in this solvent is 0.045 g/dL. The RSV is measured at 30° C. The viscosities $\eta$ and $\eta_o$ are measured using a Cannon Ubbelohde semi-micro dilution viscometer, size 75. The viscometer is mounted in a perfectly vertical position in a constant temperature bath adjusted to 30+/−0.02° C. The typical error inherent in the calculation of RSV for the polymers described herein is about 0.2 dL/g. When two polymer homologs within a series have similar RSV's that is an indication that they have similar molecular weights.

In some embodiments, the flocculant dose is at least about 0.1, 0.2, 0.5, 1, 1.5, 2, 3, 4, 5, 6, 7, 8, 9, 10, 15, 20, 25, 30, 35, 40, 45, 50, 55, 60, 65, 70, 75, 80, 85, 90, 95 or 100 kg/ton of filler treated. In some embodiments, the flocculant dose is from about 0.1 to 100 kg/ton of filler treated, from about 0.2 to about 50 kg/ton of filler treated, from about 0.2 to about 20 kg/ton of filler treated, from about 0.5 to about 10 kg/ton of filler treated, or from about 1 to about 5 kg/ton of filler treated where kg/ton refers to the kilograms of active polymer per 1 ton of dry filler. In some embodiments, the flocculant dose is about 2 kg/ton of filler treated.

In some embodiments, the filler may be 100% precipitated calcium carbonate or PCC. In such embodiments, it may be desirable to first treat the filler with an anionic flocculant and thereafter treat it with the cationic flocculant and starch according to the present disclosure.

Exemplary anionic flocculants include those made by hydrolyzing acrylamide polymer or by polymerizing anionic monomers such as (meth)acrylic acid and its salts, 2-acrylamido-2-methylpropane sulfonate, sulfoethyl-(meth)acrylate, vinylsulfonic acid, styrene sulfonic acid, maleic or other dibasic acids or their salts or mixtures thereof. These anionic monomers may also be copolymerized with nonionic monomers such as (meth)acrylamide, N-alkylacrylamides, N,N-dialkylacrylamides, methyl (meth)acrylate, acrylonitrile, N-vinyl methylacetamide, N-vinyl methyl formamide, vinyl acetate, N-vinyl pyrrolidone, and mixtures thereof.

Exemplary nonionic flocculants include those made by polymerizing nonionic monomers such as (meth)acrylamide, N-alkylacrylamides, N,N-dialkylacrylamides, methyl (meth)acrylate, acrylonitrile, N-vinyl methylacetamide, N-vinyl methyl formamide, vinyl acetate, N-vinyl pyrrolidone, and mixtures thereof.

Amphoteric flocculants include those made by polymerizing combinations of at least one anionic monomer, at least one cationic monomer, and optionally a nonionic monomer. Exemplary anionic, cationic and nonionic monomers have been described above.

Treating the Filler

In some embodiments, the starch and the flocculant are premixed together before contacting the filler. In this embodiment, the starch is fully dissolved in the solution before mixing with the flocculant. Fully dissolving the starch in the solution may be accomplished by using batch cooking or continuous cooking. In batch cooking, a slurry of starch is heated to a desired temperature (e.g., 95° C.), preferably with live steam, under continuous agitation. The starch has to be held at this temperature for at least 5, 10, 20, or 30 minutes to ensure complete solubilization of the starch granules. In continuous cooking, the dry starch is first metered into the slurry tank where it is mixed with cold water. The slurry is then pumped through a venturi jet, similar in principle to a water powered vacuum pump, where it is mixed with live steam before passing into the cooking coil where the starch is held at a temperature (e.g., 120-130° C.) for a sufficient amount of time to ensure the complete cooking of the granules. After leaving the coil, the starch solution is diluted with cold water to reduce the final concentration to around 2%. After the starch has been optionally cooked, the flocculant may be added to the starch and mixed using proper mixing device such as static mixer. The final mixture preferably includes from about 1 to about 99 wt. % starch and about 99 to about 1 wt. % flocculant, or about 10 to about 90 wt. % starch and about 90 to about 10 wt. % flocculant, or about 20 to about 80 wt. % starch and about 80 to about 20 wt. % flocculant, or about 40 to about 60 wt. % starch and about 60 to about 40 wt. % flocculant, or about 50 wt. % starch and about 50 wt. % flocculant. The starch and the flocculant may be included in a starch: flocculant weight ratio from about 1:99 to about 99:1, from about 1:9 to about 9:1, from about 1:8 to about 8:1, from about 1:5 to about 5:1, from about 1:4 to about 4:1, or from about 1:2 to about 2:1, or about 1:1.

The premixed starch and flocculant are then added to the filler before the filler is added to the papermaking furnish (e.g., in the absence of the cellulose fiber stock). The starch/flocculant premix may be dosed into the filler at a concentration of about 0.1 to about 100 kg/ton of filler, about 1 to about 10 kg/ton of filler, or about 2 to about 5 kg/ton of filler. This can be done in a batch-wise or continuous fashion. The filler concentration in these slurries is typically less than about 80% by mass and may be between about 5 and about 65% by mass, or between about 10 and about 50% by mass, or between about 15 and about 40% by mass.

A batch process can include a large mixing tank with an overhead, propeller mixer. The filler slurry is charged to the mix tank, and the desired amount of the premixed starch/flocculant is fed to the slurry under continuous mixing. The slurry and the premixed starch/flocculant are mixed for an amount of time sufficient to distribute the starch/flocculant mixture uniformly throughout the system, typically for about 1 second to 5 minutes, 5 seconds to 3 minutes, or 10 seconds to 1 minute, depending on the mixing energy used. When the appropriate size distribution of the filler floc is obtained, the mixing speed is lowered to a level at which the flocs are stable. This batch of flocculated filler is then transferred to a larger mixing tank with sufficient mixing to keep the filler flocs uniformly suspended in the dispersion. The flocculated filler is pumped from this mixing tank into the papermaking furnish.

In a continuous process, the desired amount of the premixed starch/flocculant is pumped into the pipe containing the filler and mixed with an in-line static mixer, if necessary. A length of pipe or a mixing vessel sufficient to permit adequate mixing of filler and the premixed starch/flocculant may be included. High speed mixing is then required to obtain the desired size distribution of the filler flocs. Adjusting either the shear rate of the mixing device or the mixing time can control the floc size distribution. A continuous process would lend itself to the use of an adjustable shear rate in a fixed volume device. One such device is described in U.S. Pat. No. 4,799,964. This device is an adjustable speed centrifugal pump that, when operated at a back pressure exceeding its shut off pressure, works as a mechanical shearing device with no pumping capacity. Other suitable shearing devices include a nozzle with an adjustable pressure drop, a turbine-type emulsification device, or an adjustable speed, high intensity mixer in a fixed volume vessel. After shearing, the flocculated filler slurry is fed directly into the papermaking furnish.

When the starch and the flocculant are dosed into the filler simultaneously, they may also be dosed in as part of either a batch or a continuous process in a similar concentration, dosing rate, and manner as discussed above. However, instead of being premixed together, the starch and flocculant are dosed into the filler at the desired rate and in the desired ratio or concentration at the same time instead of as part of a premixed composition.

In both the batch and continuous processes described above, the use of a filter or screen to remove oversize filler flocs can be used. This eliminates potential machine runnability and paper quality problems resulting from the inclusion of larger filler flocs in the paper or board.

In some embodiments, the treated filler has a median particle size of at least 5 μm, at least 10 μm, or at least 20 μm. In some embodiments, the median particle size of the treated filler is from about 5 to about 150 μm, from about 10 to about 75 μm, or from about 20 to about 50 μm.

The Papermaking Process

After being treated, the treated filler is then fed into and mixed with the fiber slurry. Additional paper additives may be present in the fiber slurry or added after the treated filler is combined with the fiber slurry. The mixture of filler and fiber (with other optional additives) is then pumped to a moving screen to drain the water out to create a wet paper web. The wet paper web is fed into a press to squeeze more water out mechanically. The paper web after the press is fed into a dryer to remove the rest of water through heating. Sheet strength properties are measured using the resulting dry paper.

EXAMPLES

Example 1

Example 1 treated 100% ground calcium carbonate filler with either the starch alone, the flocculant alone, or a combination of starch and flocculant with starch/flocculant ratio between 1:1 to 8:1. The starch used was C26, commercially available from General Starch Limited, Shanghai, China. The flocculant was a cationic flocculant, N-7527, a copolymer of DADMAC/Acrylamide commercially available from Nalco, an Ecolab company, Naperville, Ill., USA. The ground calcium carbonate (GCC) was commercially available from Gold East, Asian Pulp and Paper, Zhenjiang, Jiangsu Province, China.

The starch solution was prepared by adding 6 g starch powder into 294 g cold tap water under stirring at 250 rpm. The solution was heated up to 95° C. in 5 minutes. The stir speed was increased to 500 rpm and the starch was cooked for another 15 minutes. The resulting 2% starch solution was cooled down before use.

A 1% N-7527 solution was prepared by adding 1 g N-7527 into 99 g tap water and then vigorously shaken.

A mixture of N-7527 and starch was prepared by adding an appropriate amount of N-7527 into 2% starch solution to get the desired N-7527:starch ratio. This mixture was then vigorously shaken.

To treat the filler, a filler slurry was diluted using tap water to a 10% concentration. A 300 ml diluted filler solution was stirred under 800 rpm. An appropriate amount of starch, N-7527 or the premixed combination of starch and N-7527 was added into the slurry using a syringe. After the addition of chemicals, the stirring rate was raised to 1500 rpm to shear the slurry for 2 minutes. The particle size distribution of resulting filler slurry was then measured using a Malvern Mastersizer, commercially available from Malvern Instruments Ltd, Worcestershire, UK. Median particle size or D(v,0.5) was recorded for each solution.

The results are shown in FIG. 1 and show that when the starch and the flocculant are premixed together and then combined with filler, the particle size of the filler is larger than when starch or flocculant alone are mixed with the filler.

Example 2

In this example, 100% ground calcium carbonate (GCC, from Gold East, Asian Pulp and Paper, Zhenjiang, Jiangsu Province, China was treated with either starch, flocculant, or a combination of starch+flocculant in a ratio of either 1:1 or 4:1. The treatment procedure was the same as example 1. Untreated filler (100% GCC) was used as a control. The starch was C26 from General Starch Limited and the cationic flocculant was N-7527 from Nalco.

Handsheet Preparation:

Thin stock with a 0.5% consistency was mixed in a beaker at 800 rpm. The stock was obtained from Gold East, Asian Pulp and Paper, Zhenjiang, JiangSu Province, China. At the start of the mixing, the proper amount of untreated or treated filler was added to the furnish, followed by the following papermaking additives: 10 kg/ton Stalok 400 starch at 15 seconds, 0.6 kg/ton N-62101 at 30 seconds, 2.5 kg/ton Bentonite at 45 seconds and 0.5 kg/ton N7546 at 60 seconds. N-62101 is a cationic copolymer of MCQ.DMAEA/acrylamide and N-7546 is an anionic copolymer of acrylamide/sodium acrylate. Both N-62101 and N-7546 are commercially available from Nalco, an Ecolab company (Naperville, Ill., USA). Mixing was stopped at 75 seconds and the furnish was transferred into the deckle box of a FORMAX™ handsheet mold. The handsheet mold was filled to the designated line with water for each sheet. An 8" square handsheet was formed by drainage through an 80 mesh forming wire. The handsheet was couched from the sheet mold by placing two blotters and a metal plate on the wet handsheet and roll-pressing with six passes of a 25 lb metal roller. The forming wire and top blotter were removed and the handsheet and blotter were placed on top of two new blotters. A metal plate was then placed on top of the handsheet. Five formed handsheets were stacked on top of one another in this manner (new blotter, formed handsheet and blotter, plate) and placed in the L&W handsheet press for five minutes at a pressure setting of 0.565 MPa. The handsheet label was placed on the lower-right-wire side of the sheet and this side was in contact with the dryer surface. Sheets were dried at 105° C. for 60 seconds in a single pass using a rotary drum dryer.

Handsheet Physical Testing:

The sheets were stored overnight at 50% humidity and 23° C. prior to testing. The sheets were evaluated for basis weight, ash content, caliper and Scott bond. Scott bond was measured according to TAPPI test method T 541 om-89, basis weight was measured according to TAPPI test method T 410 om-98, and ash content was measured according to TAPPI test method T 211 om-93.

Figure 2:
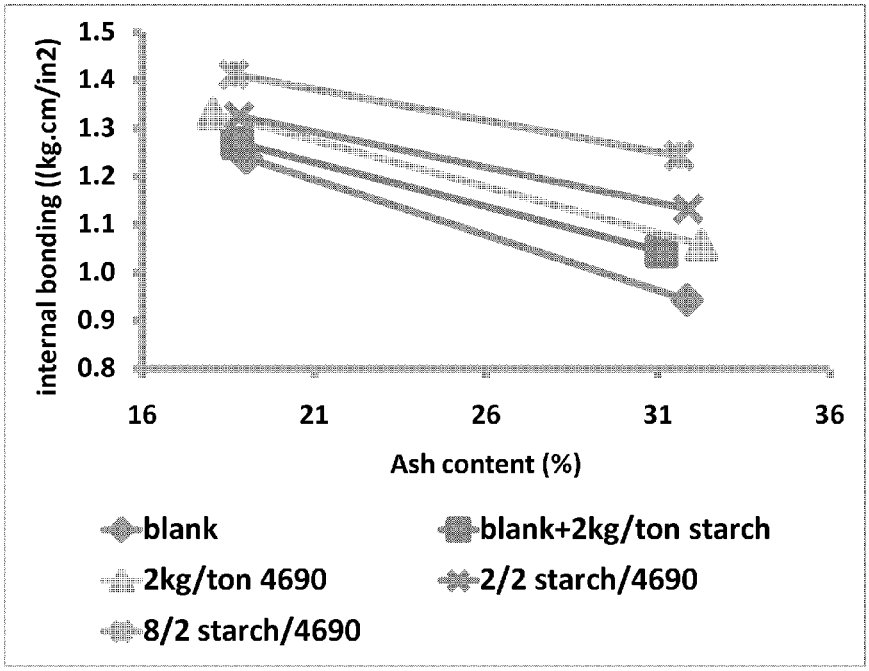
FIG. 2 is a graph showing the sheet strength of various filler treatments as the filler content of the paper is increased.

The results are shown in FIG. 2 and demonstrate that sheets with filler treated by the mixture of had significant higher Scott bond or internal strength. This was observed for both the 1:1 and 4:1 ratios of starch:flocculant.

Example 3

Example 3 tested the shear stability of a filler floc. This example was the same as Example 1 except that the filler was a 1:1 mixture of ground calcium carbonate (GCC) and precipitated calcium carbonate (PCC). GCC/PCC filler was treated with cationic flocculant, or cationic starch or the mixture of cationic flocculant and cationic starch. The starch was C26, commercially available from General Starch Limited. The cationic flocculant was DEV210, a DMAE-A.MCQ/Acrylamide copolymer commercially available from Nalco, an Ecolab company, Naperville, Ill., USA. Untreated GCC and PCC were used as the control.

In Example 3, the flocculated filler slurry was sheared under 1500 rpm for various times to investigate the shear stability of filler flocs.

Figure 3:
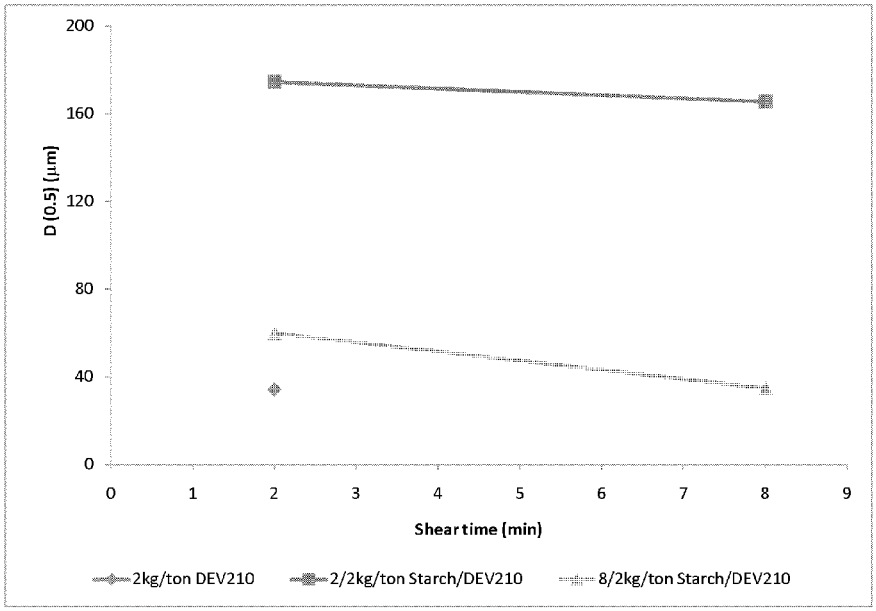
FIG. 3 is a graph of the particle size of various filler treatments as the shear time is increased.

The results are shown in FIG. 3 and show that when the starch and the flocculant are premixed together and then combined with the filler, the particle size of the filler is larger than when the starch or the flocculant alone are mixed with the filler. Furthermore, the mixture of cationic starch and cationic flocculant created filler flocs that are more shear resistant.

Example 4

Example 4 was the same as example 2 except that the filler was a 1:1 mixture of ground calcium carbonate (GCC) and precipitated calcium carbonate (PCC). The filler was treated as in Example 3, i.e. filler was treated either by 2 kg/ton DEV210 alone or treated by the mixture of 2 kg/ton DEV210 and 2 kg/ton cationic starch. Untreated GCC and PCC was used as the control.

Figure 4:
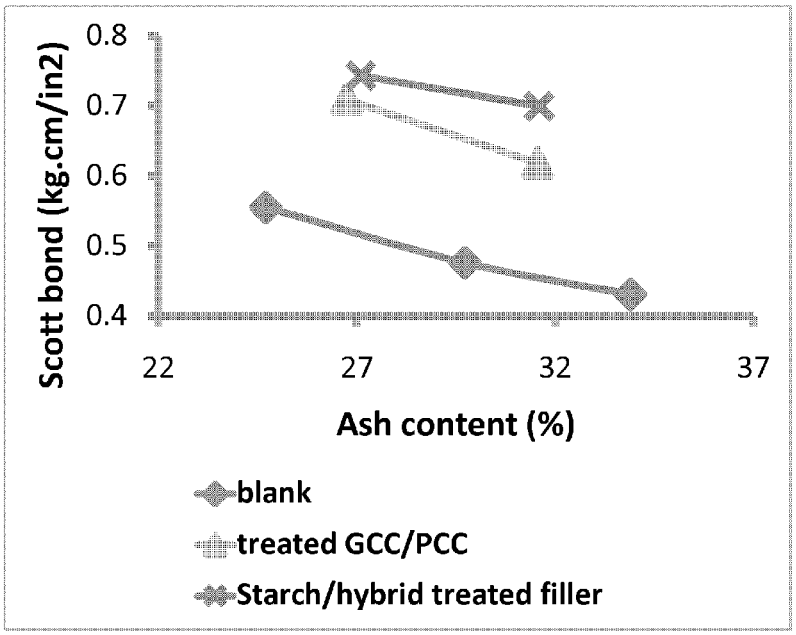
FIG. 4 is a graph showing the sheet strength of various filler treatments as the filler content of the paper is increased.

The results are shown in FIG. 4, which shows that the sheets with filler treated by the mixture of cationic flocculant and cationic starch had significantly higher Scott Bond.

Example 5

In this example, 100% ground calcium carbonate (from Jinhai, Asia Pulp and Paper, Haikou, Hainan Province, China) was treated with combination of starch+flocculant in a ratio of 0.25:1, 0.5:1, 1:1 and 4:1. The flocculant dosage was 2 kg/ton filler. The starch was C26, a cationic starch commercially available from General Starch Limited. The flocculant was DEV210, commercially available from Nalco, an Ecolab company, Naperville, Ill., USA. The filler treated process was the same as example 1 except that the shearing speed and time was 1500 rpm for 8 minutes. The results are shown in table 1 and demonstrate that increasing the concentration of the starch relative to the flocculant resulted in a larger particle size of the treated filler.

Example 6

Example 6 was the same as Example 5 except that starch and flocculant were added simultaneously (not premixed) and the ratio was 1:1. The flocculant dose was 2 kg/ton filler. The results are shown in table 1 and demonstrate that the simultaneous addition of the starch and the flocculant resulted in improved (larger) filler particle size than comparable concentrations of flocculant and starch added sequentially.

Example 7

Example 7 was the same as Example 5 except that starch was added first and then the flocculant was added in a ratio of 1:1. The flocculant dose was 2 kg/ton filler. The results are shown in table 1 and demonstrate that the sequential addition of the flocculant and starch produced a treated filler with smaller particle sizes when compared against the premixed starch and flocculant or the simultaneous addition of the starch and flocculant.

Example 8

Example 8 was the same as Example 5 except that flocculant was added first and then the starch was added in a ratio of 1:1. The flocculant dose was 2 kg/ton filler. The results are shown in table 1 and demonstrate that the sequential addition of the flocculant and starch produced a treated filler with smaller particle sizes when compared against the premixed starch and flocculant or the simultaneous addition of the starch and flocculant.

Example 9

Example 9 was the same as Example 5 except that starch was natural potato starch (commercially available from Sinopharm Chemical Reagent Co., Ltd, China, production number is 69023736) and the starch+flocculant ratio was 1:1. The flocculant dose was 2 kg/ton filler. The results are shown in table 1. The data demonstrates that premixing cationic starch and raw starch could also increase the performance compared to cationic starch alone.

TABLE 1

| Example | treated method | Span | d (v, 0.1) | d (v, 0.5) m | d (v, 0.9) |
|---|---|---|---|---|---|
| | untreated GCC | 1.85 | 1.2 | 2.8 | 6.4 |
| | 2 kg/ton DEV210 | 1.93 | 21.7 | 54.4 | 126.9 |
| 5 | 2/0.5 kg/ton DEV210/c starch | 1.89 | 23.1 | 58.0 | 132.7 |
| 5 | 2/1 kg/ton DEV210/c starch | 1.77 | 25.6 | 64.1 | 138.8 |
| 5 | 2/2 kg/ton DEV210/c starch | 1.68 | 34.1 | 84.7 | 176.3 |
| 5 | 2/4 kg/ton DEV210/c starch | 1.54 | 47.9 | 112.5 | 221.1 |
| 6 | 2 kg/ton DEV210 2 kg/ton C Starch cofeed | 1.80 | 25.9 | 68.7 | 149.7 |
| 7 | 2 kg/ton DEV210 then 2 kg/ton C Starch | 2.02 | 22.2 | 59.7 | 142.7 |
| 8 | 2 kg/ton C Starch then 2 kg/ton DEV210 | 1.69 | 25.5 | 63.4 | 132.4 |
| 9 | 2/2 kg/ton DEV210/N Starch | 1.80 | 28.0 | 69.4 | 152.9 |

Example 10

For this example, 100% Precipitated Calcium Carbonate (PCC, from Gold East, Asian Pulp and Paper, Zhenjiang, Jiangsu Province, China) was first treated with an anionic flocculant, DEV117, which is a copolymer of acrylamide and ammonium acrylate available from Nalco, an Ecolab company, Naperville, Ill., USA and then with either cationic flocculant, or a combination of starch and cationic flocculant in a ratio of either 1:1 or 4:1. The flocculant dose was 2 kg/ton filler. Untreated filler (100% PCC) was used as a control. The starch was a cationic starch from General Starch Limited C26. The cationic flocculant was DEV210, commercially available from Nalco, an Ecolab company, Naperville, Ill., USA. The results are shown in table 2 and demonstrate that premixing cationic flocculant and starch improves the particle size of the nondispersed filler (PCC) when an anionic flocculant is added first.

TABLE 2

| treated method | Span | d (v, 0.1) | d (v, 0.5) m | d (v, 0.9) |
|---|---|---|---|---|
| untreated PCC | 1.10 | 2.41 | 4.09 | 6.92 |
| 2 kg/ton DEV117 2 kg/ton DEV210 | 1.43 | 22.44 | 47.13 | 89.81 |
| 2 kg/ton DEV117 2/2 kg/ton DEV210/Starch | 1.44 | 28.92 | 61.69 | 117.56 |
| 2 kg/ton DEV117 2/8 kg/ton DEV210/Starch | 1.59 | 30.03 | 68.57 | 138.71 |

Example 11

Example 11 was the same as Example 10 except that filler was chalk (from JinGui, Asian Pulp and Paper, Qinzhou, Guangxi Province, China). The results are shown in table 3 and demonstrate that premixing cationic flocculant and starch can improve the particle size of the nondispersed filler (chalk) when an anionic flocculant is added first.

TABLE 3

| treated method | Span | d (v, 0.1) | d (v, 0.5) m | d (v, 0.9) |
|---|---|---|---|---|
| untreated chalk | 2.04 | 3.98 | 12.5 | 29.42 |
| 2 kg/ton DEV117, 1 kg/ton DEV210 | 1.62 | 36.37 | 89.30 | 180.85 |

TABLE 3-continued

| treated method | Span | d (v, 0.1) | d (v, 0.5) m | d (v, 0.9) |
|---|---|---|---|---|
| 2 kg/ton DEV117, 1/4 kg/ton DEV210/Starch | 1.49 | 45.58 | 103.12 | 199.28 |

The above specification, examples and data provide a complete description of the manufacture and use of the composition of the disclosure. Since many embodiments of the disclosure can be made without departing from the spirit and scope of the disclosure, the invention resides in the claims.

What is claimed is:

1. A method of papermaking comprising:

a. heating a cationic starch solution to a desired temperature to solubilize the cationic starch;

b. combining a filler with the cationic starch solution and a cationic flocculant;

c. subjecting the filler, cationic starch solution, and cationic flocculant to shear forces to form a filler floc with a median particle size of about 5 to about 150 microns;

d. combining the filler floc with a cellulose fiber stock; and e. forming a paper mat from the combination of the filler floc and the cellulose fiber stock.

2. The method of claim 1, wherein the cationic starch and the cationic flocculant have been premixed together before treatment with the filler.

3. The method of claim 1, wherein the cationic starch and the cationic flocculant are added to the filler separately and simultaneously.

4. The method of claim 1, wherein the filler is a dispersed slurry.

5. The method of claim 1, wherein the filler is a nondispersed filler in dry form.

6. The method of claim 1, wherein the filler is selected from the group consisting of calcium carbonate, kaolin clay, talc, titanium dioxide, silica, silicate, aluminum hydroxide, calcium sulfate, alumina trihydrate, barium sulfate, magnesium hydroxide, and combinations thereof.

7. The method of claim 1, wherein the cationic starch is selected to have a charge density of from about 1 to about 5 mol. %.

8. The method of claim 1, wherein the cationic flocculant is selected from the group consisting of homopolymers, copolymers, and terpolymers of (meth)acrylamide, diallyl-N,N-disubstituted ammonium halide, dimethylaminoethyl methacrylate and its quaternary ammonium salts, dimethylaminoethyl acrylate and its quaternary ammonium salts, methacrylamidopropyltrimethylammonium chloride, diallylmethyl(beta-propionamido)ammonium chloride, (beta-methacryloyloxyethyl)trimethyl ammonium methylsulfate, quaternized polyvinyllactam, vinylamine, acrylamide or methacrylamide that has been reacted to produce Mannich or quaternary Mannich derivatives, and combinations thereof.

9. The method of claim 8, wherein the cationic flocculant is selected from the group consisting of a copolymer of a quaternized N,N-dialkylaminoethyl (meth)acrylate (DMAEA.MCQ) and acrylamide, a copolymer of diallyldimethylammonium chloride (DADMAC) and acrylamide, and combinations thereof.

10. The method of claim 1, wherein the weight ratio of starch:flocculant is from about 1:9 to about 9:1.

11. The method of claim 2, wherein the starch and flocculant are premixed together in a weight ratio from about 1:9 to about 9:1.

12. The method of claim 11, wherein the starch and flocculant are premixed together in a weight ratio from about 1:4 to about 4:1.

13. The method of claim 1, wherein the cationic flocculant has a charge density of from about 1 to about 50 mol. %.

14. The method of claim 13, wherein the cationic flocculant has a charge density of from about 10 to about 30 mol. %.

15. The method of claim 1, wherein the median particle size of the filler floc is from about 10 to about 75 microns.

16. The method of claim 1, wherein the filler is 100% nondispersed filler in dry form and an anionic flocculant is added to the filler before the addition of the cationic flocculant and starch.

* * * * *